US007752039B2

(12) United States Patent
Bessette

(10) Patent No.: US 7,752,039 B2
(45) Date of Patent: Jul. 6, 2010

(54) METHOD AND DEVICE FOR LOW BIT RATE SPEECH CODING

(75) Inventor: Bruno Bessette, Quebec (CA)

(73) Assignee: Nokia Corporation, Espoo (FI)

( * ) Notice: Subject to any disclaimer, the term of this patent is extended or adjusted under 35 U.S.C. 154(b) by 938 days.

(21) Appl. No.: 11/265,440

(22) Filed: Nov. 1, 2005

(65) Prior Publication Data

US 2006/0106600 A1 May 18, 2006

Related U.S. Application Data

(60) Provisional application No. 60/624,998, filed on Nov. 3, 2004.

(51) Int. Cl.
*G10L 19/12* (2006.01)
*G10L 19/14* (2006.01)
*G10L 19/02* (2006.01)

(52) U.S. Cl. ..... 704/223; 704/219; 704/220; 704/222; 704/224; 704/225; 704/229

(58) Field of Classification Search ..... 704/219, 704/220, 222, 223, 224, 225, 229
See application file for complete search history.

(56) References Cited

U.S. PATENT DOCUMENTS

| | | | | |
|---|---|---|---|---|
| 5,884,251 | A | 3/1999 | Kim et al. | 704/219 |
| 6,044,339 | A * | 3/2000 | Zack et al. | 704/223 |
| 6,272,459 | B1 * | 8/2001 | Takahashi | 704/221 |
| 6,311,154 | B1 * | 10/2001 | Gersho et al. | 704/219 |
| 6,345,225 | B1 * | 2/2002 | Bohm et al. | 701/70 |
| 6,345,255 | B1 * | 2/2002 | Mermelstein | 704/500 |
| 6,397,178 | B1 * | 5/2002 | Benyassine | 704/230 |
| 6,424,941 | B1 * | 7/2002 | Yu | 704/221 |
| 6,604,070 | B1 * | 8/2003 | Gao et al. | 704/222 |
| 6,789,059 | B2 * | 9/2004 | Kandhadai et al. | 704/216 |

(Continued)

FOREIGN PATENT DOCUMENTS

EP 1020848 A2 7/2000

(Continued)

OTHER PUBLICATIONS

D. Lin, "New approaches to stochastic coding of speech sources at very low bit rates," in Signal Processing III: Theories and Applications, I.T. Young et al., Eds. Amsterdam, The Netherlands: Elsevier, North-Holland, 1986 pp. 445-447.*

(Continued)

*Primary Examiner*—David R Hudspeth
*Assistant Examiner*—Edgar Guerra-Erazo
(74) *Attorney, Agent, or Firm*—Harrington & Smith

(57) ABSTRACT

A method for coding speech or other generic signals includes dividing a speech signal into a plurality of frames, and dividing at least one of the plurality of frames into at least two subframe units. A search for a fixed codebook contribution and an adaptive codebook contribution for subframe units is conducted. At least one subframe unit is selected to be coded without the fixed codebook contribution. The encoder may iteratively arrange and encode subframes differently for the same frame, and select for transmission that arrangement that minimizes an error measure across the frame. Various embodiments are shown, as are embodied computer programs, a decoder, and a communication system.

50 Claims, 3 Drawing Sheets

U.S. PATENT DOCUMENTS

| | | | | |
|---|---|---|---|---|
| 6,996,522 | B2 * | 2/2006 | Chen | 704/219 |
| 7,251,598 | B2 * | 7/2007 | Nomura | 704/221 |
| 2002/0123887 | A1 * | 9/2002 | Unno | 704/220 |
| 2003/0177004 | A1 * | 9/2003 | Jabri et al. | 704/219 |
| 2004/0204935 | A1 | 10/2004 | Anandakumar et al. | 704/230 |

FOREIGN PATENT DOCUMENTS

EP 1049073 A2 * 11/2000

OTHER PUBLICATIONS

D. Lin, "New approaches to stochastic coding of speech sources at very low bit rates," in Signal Processing III: Theories and Applications, I.T. Young et al., Eds. Amsterdam, The Netherlands: Elsevier, North-Holland, 1986 pp. 445-447.*

A. V. Rao, S. Ahmadi, J. Linden, A. Gersho, V. Cuperman, and R. Heidari, "Pitch adaptive windows for improved excitation coding in low-rate CELP coders," IEEE Transactions on Speech and Audio Processing, vol. 11, pp. 648-659, 2003.*

EIC Search Report Mar. 11, 2010.*

Zhang, L. et al., "A CELP Variable Rate Speech Codec With Low Average Rate", Apr. 21-24, 1997, pp. 735-738, IEEE International Conference on Acoustics, Speech and Signal Processing.

Woodard J. P. et al., "Improvements To The Analysis-By-Synthesis Loop in CELP Codecs", Sep. 26-28, 1995, pp. 114-118, Radio Receivers and Associated Systems.

"On the Architecture of the CDMA 2000® Variable-Rate Multimode Wideband (VMR-WB) Speech Coding Standard", Milan-Jelinek et al., IEEE 2004, 4 pgs.

* cited by examiner

METHOD AND DEVICE FOR LOW BIT RATE SPEECH CODING

CROSS REFERENCE TO RELATED APPLICATION

This application claims priority to U.S. Provisional Patent Application Ser. No. 60/624,998, filed on Nov. 3, 2004 and incorporated herein by reference.

TECHNICAL FIELD

The present invention relates to digital encoding of sound signals, in particular but not exclusively a speech signal, in view of transmitting and synthesizing this sound signal. In particular, the present invention relates to a method for efficient low bit rate coding of a sound signal based on code-excited linear prediction coding paradigm.

BACKGROUND

Demand for efficient digital narrowband and wideband speech coding techniques with a good trade-off between the subjective quality and bit rate is increasing in various application areas such as teleconferencing, multimedia, and wireless communications. Until recently, telephone bandwidth constrained into a range of 200-3400 Hz has mainly been used in speech coding applications. However, wideband speech applications provide increased intelligibility and naturalness in communication compared to the conventional telephone bandwidth. A bandwidth in the range 50-7000 Hz has been found sufficient for delivering a good quality giving an impression of face-to-face communication. For general audio signals, this bandwidth gives an acceptable subjective quality, but is still lower than the quality of FM radio or CD that operate on ranges of 20-16000 Hz and 20-20000 Hz, respectively.

A speech encoder converts a speech signal into a digital bit stream, which is transmitted over a communication channel or stored in a storage medium. The speech signal is digitized, that is, sampled and quantized with usually 16-bits per sample. The speech encoder has the role of representing these digital samples with a smaller number of bits while maintaining a good subjective speech quality. The speech decoder or synthesizer operates on the transmitted or stored bit stream and converts it back to a sound signal.

Code-Excited Linear Prediction (CELP) coding is a well-known technique allowing achieving a good compromise between the subjective quality and bit rate. This coding technique is a basis of several speech coding standards both in wireless and wired applications. In CELP coding, the sampled speech signal is processed in successive blocks of L samples usually called frames, where L is a predetermined number corresponding typically to 10-30 ms. A linear prediction (LP) filter is computed and transmitted every frame. The computation of the LP filter typically needs look ahead, e.g. a 5-15 ms speech segment from the subsequent frame. The L-sample frame is divided into smaller blocks called subframes. Usually the number of subframes is three or four resulting in 4-10 ms subframes. In each subframe, an excitation signal is usually obtained from two components, the past excitation and the innovative, fixed-codebook excitation. The component formed from the past excitation is often referred to as the adaptive codebook or pitch excitation. The parameters characterizing the excitation signal are coded and transmitted to the decoder, where the reconstructed excitation signal is used as the input of the LP filter.

In wireless systems using code division multiple access (CDMA) technology, the use of source-controlled variable bit rate (VBR) speech coding significantly improves the system capacity. In source-controlled VBR coding, the codec operates at several bit rates, and a rate selection module is used to determine the bit rate used for encoding each speech frame based on the nature of the speech frame (e.g. voiced, unvoiced, transient, background noise). The goal is to attain the best speech quality at a given average bit rate, also referred to as average data rate (ADR). The codec can operate at different modes by tuning the rate selection module to attain different ADRs at the different modes where the codec performance is improved at increased ADRs. The mode of operation is imposed by the system depending on channel conditions. This enables the codec with a mechanism of trade-off between speech quality and system capacity.

Typically, in VBR coding for CDMA systems, the eighth-rate is used for encoding frames without speech activity (silence or noise-only frames). When the frame is stationary voiced or stationary unvoiced, half-rate or quarter-rate are used depending on the operating mode. If half-rate can be used, a CELP model without the pitch codebook is used in unvoiced case and a signal modification is used to enhance the periodicity and reduce the number of bits for the pitch indices in voiced case. If the operating mode imposes a quarter-rate, no waveform matching is usually possible as the number of bits is insufficient and some parametric coding is generally applied. Full-rate is used for onsets, transient frames, and mixed voiced frames (a typical CELP model is usually used). In addition to the source controlled codec operation in CDMA systems, the system can limit the maximum bit-rate in some speech frames in order to send in-band signalling information (called dim-and-burst signalling) or during bad channel conditions (such as near the cell boundaries) in order to improve the codec robustness. This is referred to as half-rate max.

As can be seen from the above description, efficient low bit rate coding (at half-rates) is very essential for efficient VBR coding, to enable the reduction in the average data rate while maintaining good sound quality, and also to maintain a good performance when the codec is forced to operate in maximum half-rate.

SUMMARY

The present invention is directed toward a method for low bit rate CELP coding. This method is suitable for coding half-rate modes (generic and voiced) in a source-controlled variable-rate speech coding system. The foregoing and other problems are overcome, and other advantages are realized, in accordance with the presently described embodiments of these teachings.

In accordance with one aspect, the present invention is a method for coding a speech signal. In the method a speech signal is divided into a plurality of frames, and at least one of the frames is divided into at least two subframe units. A search is conducted for a fixed codebook contribution and for an adaptive codebook contribution for the subframe units. At least one subframe unit is selected to be coded without the fixed codebook contribution.

In accordance with another embodiment is an encoder. The encoder has a first input coupled to a codebook and a second input for receiving a speech signal. The encoder operates, for the received speech signal, to search the codebook for a fixed codebook contribution and for an adaptive codebook contribution, and to output the speech signal as a frame that includes the at least two subframe units. The encoder encodes at least one of the subframe units of the frame without the fixed codebook contribution.

In accordance with another aspect, the present invention is a program of machine-readable instructions, tangibly embodied on an information bearing medium and executable by a digital data processor, to perform actions directed toward encoding a speech frame. The actions include dividing a speech signal into a plurality of frames, and dividing at least one of the plurality of frames into at least two subframe units. A search is conducted for a fixed codebook contribution and an adaptive codebook contribution for the subframe units. At least one subframe unit is selected to be coded without the fixed codebook contribution.

In accordance with another aspect, the present invention is an encoding device that has means for dividing a speech signal into a plurality of frames and means for dividing at least one of the plurality of frames into at least two subframe units. This may be an encoder. The device further has means for searching for a fixed codebook contribution and an adaptive codebook contribution for subframe units, such as a processor coupled to the encoder and to a computer readable memory that stores a codebook. The device further has means for selecting at least one subframe unit to be coded without the fixed codebook contribution, the selecting means preferably also the processor.

In accordance with yet another aspect is a communication system that has an encoder and a decoder. The encoder includes a first input coupled to a codebook and a second input for receiving a speech signal to be transmitted. The encoder operates, for the received speech signal, to search the codebook for a fixed codebook contribution and for an adaptive codebook contribution and to output the speech signal (or at least a portion thereof) as a frame that has at least two subframe units. The encoder further operates to encode at least one subframe unit of the frame without the fixed codebook contribution. The decoder of the communication system has a first input coupled to a codebook and a second input for inputting an encoded frame of a speech signal received over a channel. The encoded speech frame includes at least two subframe units. The decoder operates, for the received encoded speech frame, to search the codebook for a fixed codebook contribution and for an adaptive codebook contribution, and to decode at least one of the subframe units without the fixed codebook contribution.

Further details as to various embodiments and implementations are detailed below.

BRIEF DESCRIPTION OF THE DRAWINGS

The foregoing and other aspects of these teachings are made more evident in the following Detailed Description, when read in conjunction with the attached Drawing Figures, wherein.

DETAILED DESCRIPTION

The use of source-controlled VBR speech coding significantly improves the capacity of many communications systems, especially wireless systems using CDMA technology. In source-controlled VBR coding, the codec operates at several bit rates, and a rate selection module is used to determine the bit rate used for encoding each speech frame based on the nature of the speech frame (e.g. voiced, unvoiced, transient, background noise). Reference in this regard may be found in co-owned U.S. patent application Ser. No. 10/608,943, entitled "Low-Density Parity Check Codes for Multiple Code Rates" by Victor Stolpman, filed on Jun. 26, 2003 and incorporated herein by reference. In VBR coding, the goal is to attain the best speech quality at a given average data rate. The codec can operate at different modes by tuning the rate selection module to attain different ADRs at the different modes where the codec performance is improved at increased ADRs. In some systems, the mode of operation is imposed by the system depending on channel conditions. This enables the codec with a mechanism of trade-off between speech quality and system capacity.

In the cdma2000 system, two sets of bit rate configurations are defined. In Rate Set I, the bit rates are: Full-Rate (FR) at 8.55 kbit/s, Half-Rate (HR) at 4 kbit/s, Quarter-Rate (QR) at 2 kbit/s, and Eighth-rate (ER) at 0.8 kbit/s. In Rate Set II, the bit rates are FR at 13 kbit/s, HR at 6.2 kbit/s, QR at 2.7 kbit/s, and ER at 1 kbit/s.

In an illustrative embodiment of the present invention, the disclosed method for low bit rate coding is applied to half-rate coding in Rate Set I operation. In particular, an embodiment is illustrated whereby the disclosed method is incorporated into a variable bit rate wideband speech codec for encoding Generic HR frames and Voiced HR frames at 4 kbit/s. Particular are discussed in detail beginning at FIG. 3.

Figure 1:
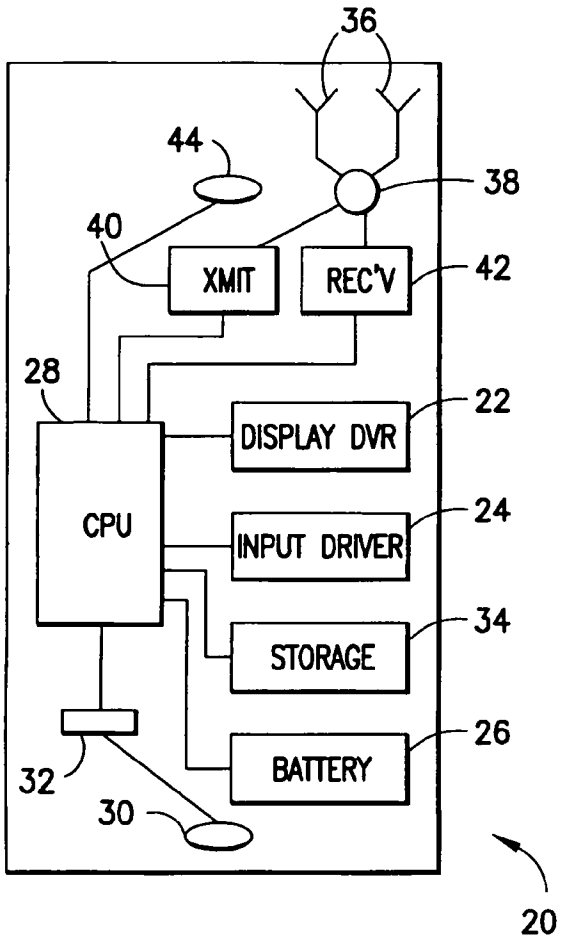

FIG. 1 illustrates a schematic diagram of a mobile station MS 20 in which the present invention may be embodied. The present invention may be disposed in any host computing device having a variable rate encoder, whether or not the device is mobile, whether or not it is coupled to a cellular of other data network. A MS 20 is a handheld portable device that is capable of wirelessly accessing a communication network, such as a mobile telephony network of base stations that are coupled to a publicly switched telephone network. A cellular telephone, a Blackberry® device, and a personal digital assistant (PDA) with internet or other two-way communication capability are examples of a MS 20. A portable wireless device includes mobile stations as well as additional handheld devices such as walkie talkies and devices that may access only local networks such as a wireless localized area network (WLAN) or a WIFI network.

The component blocks illustrated in FIG. 1 are functional and the functions described below may or may not be performed by a single physical entity as described with reference to FIG. 1. A display driver 22, such as a circuit board for driving a graphical display screen, and an input driver 24, such as a circuit board for converting inputs from an array of user actuated buttons and/or a joystick to electrical signals, are provided with a display screen and button/joystick array (not shown) for interfacing with a user. The input driver 24 may also convert user inputs at the display screen when such display screen is touch sensitive, as known in the art. The MS 20 further includes a power source 26 such as a self-contained battery that provides electrical power to a central processor 28 that controls functions within the MS 20. Within the processor 28 are functions such as digital sampling, decimation, interpolation, encoding and decoding, modulating and demodulating, encrypting and decrypting, spreading and despreading (for a CDMA compatible MS 20), and additional signal processing functions known in the art.

Voice or other aural inputs are received at a microphone 30 that may be coupled to the processor 28 through a buffer memory 32. Computer programs such as algorithms to modulate, encode and decode, data arrays such as codebooks for coders/decoders (codecs) and look-up tables, and the like are stored in a main memory storage media 34 which may be an electronic, optical, or magnetic memory storage media as is known in the art for storing computer readable instructions and programs and data. The main memory 34 is typically partitioned into volatile and non-volatile portions, and is commonly dispersed among different storage units, some of which may be removable. The MS 20 communicates over a network link such as a mobile telephony link via one or more antennas 36 that may be selectively coupled via a T/R switch 38, or a diplex filter, to a transmitter 40 and a receiver 42. The MS 20 may additionally have secondary transmitters and receivers for communicating over additional networks, such as a WLAN, WIFI, Bluetooth®, or to receive digital video broadcasts. Known antenna types include monopole, di-pole, planar inverted folded antenna PIFA, and others. The various antennas may be mounted primarily externally (e.g., whip) or completely internally of the MS 20 housing as illustrated. Audible output from the MS 20 is transduced at a speaker 44. Most of the above-described components, and especially the processor 28, are disposed on a main wiring board (not shown). Typically, the main wiring board includes a ground plane to which the antenna(s) 36 are electrically coupled.

Figure 2:
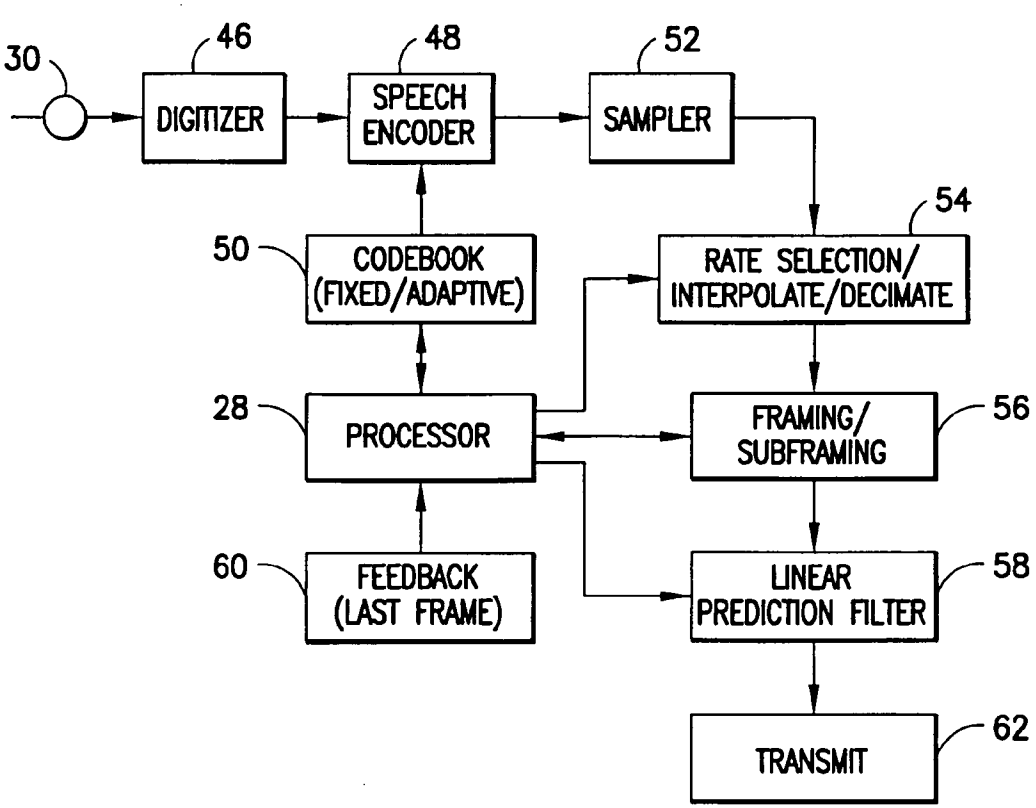
FIGS. 1 and 2 are respective block diagrams of a mobile station and elements within the mobile station according to an embodiment of the present invention.

FIG. 2 is a schematic block diagram of processes and circuitry executed within, for example the MS 20 of FIG. 1, according to embodiments of the invention. A speech signal output from the microphone is digitized at a digitizer and encoded at an encoder 48 using a codebook 50 stored in memory 34. The codebook or mother code has both fixed and adaptive portions for variable rate encoding. A sampler 52 and rate selector 54 achieve a coding rate by sampling and interpolating/decimating or by other means known in the art. The rate among frames may vary as discussed above. Data is parsed into subframes at block 56, the subframes are divided by type and assembled into frames by any of the approaches disclosed below. In general, the processor 28 assembles subframes of different type into a single frame in such a manner as to minimize an error measure. In some embodiments, this is iterative in that the processor determines a gain using only an adaptive portion of the codebook 50, applies it to one of two subframes in the frame and to the other frame applies gain derived from both the fixed and adaptive codebook portions. Consider this result a first calculation. A second calculation is the reverse; the fixed gain from the adaptive codebook portion only is applied to the other subframe and the gain derived from the fixed and adaptive codebook is applied to the original subframe, resulting in a second calculation. Whichever of the first or second calculation minimizes an error measure is the one representative of how the subframes are excited by a linear prediction filter 58. That excitation comes from the processor, which iteratively determined the optimal excitation on a subframe by subframe basis. Other techniques are disclosed below. In some embodiments, a feedback 60 of energy used to excite the frame immediately previous to the current frame is used to determine a fixed pitch gain applied to one of the subframes in a frame. The value of that energy may be merely stored in the memory 34 and re-accessed by the processor 28. Various other hardware arrangements may be compiled that operate on the speech signal as described herein without departing from these teachings.

The detailed description of embodiments of the invention is illustrated using the attached text, which corresponds to the description of a variable rate multi-mode wideband coder currently submitted for standardization in 3GPP2 [3GPP2 C.S0052-A: "Source-Controlled Variable Rate Multimode Wideband Speech Codec (VMR-WB), Service Options 62 and 63 for Spread Spectrum Systems"], hereby incorporated by reference. A new enhancement to that standard includes modes of operation using what is termed a Rate Set I configuration, which necessitates the design of HR Voiced and HR Generic coding types at 4 kbps. To be able to reduce the bit rate while keeping the same codec structures and with limited use of extra memory, the ideas of the present inventions described below are incorporated.

According to a first embodiment, the speech coding system uses a linear predictive coding technique. A speech frame is divided into several subframe units or subframes, whereby the excitation of the linear prediction (LP) synthesis filter is computed in each subframe. The subframe units may preferably be half-frames or quarter-frames. In a traditional linear predictive coder, the excitation consists of an adaptive codebook and a fixed codebook scaled by their corresponding gains. In embodiments of the invention, in order to reduce the bit rate while keeping good performance, several K subframes are grouped and the pitch lag is computed once for the K subframes. Then, when determining the excitation in individual subframes, some subframes use no fixed codebook contribution, and for those frames the pitch gain is fixed to a certain value. The remaining subframes use both fixed and adaptive codebook contributions. In a preferred embodiment, several iterations are performed whereby in said iterations the subframes with no fixed codebook contribution are assigned differently to obtain several combinations of subframes with fixed codebook contribution and subframes with no fixed codebook contribution; and whereby the best combination is determined by minimizing an error measure. Further, the index of the best combination resulting in minimum error is encoded.

In a variation, the pitch gain in the subframes that have no fixed codebook contribution is set to a value given by the ratio between the energies of LP synthesis filters from previous and current frames. This is shown in FIG. 3.

Figure 3:
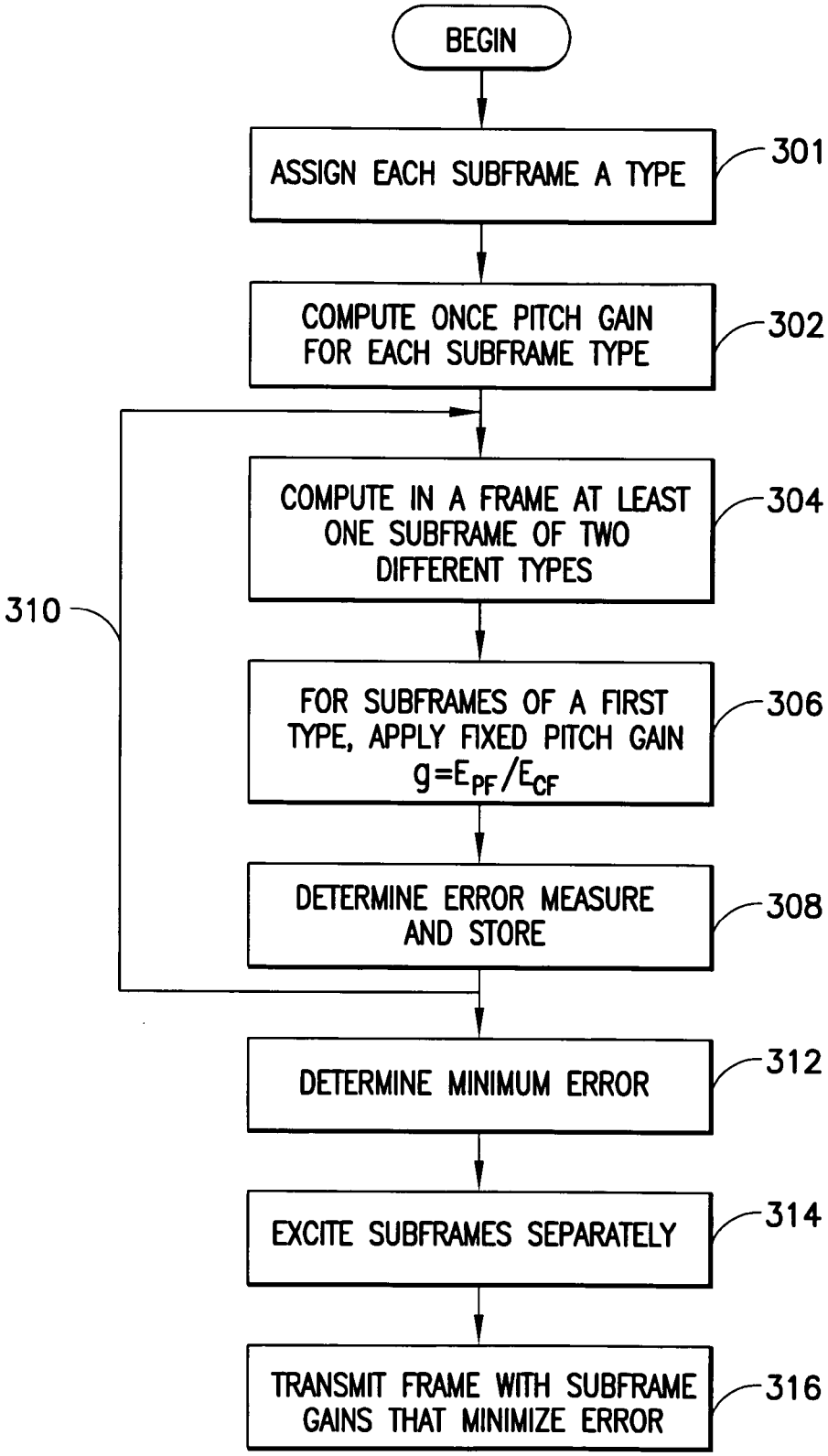
FIG. 3 is process flow diagram according to a first embodiment of the invention.

In FIG. 3, each subframe is assigned a type 301. For all subframes of a particular type, the pitch gain is computed once and stored 302. The processor 28 then iteratively computes various combinations of subframes of different types into a frame using the calculated pitch gains 304. For subframes of a first type, those excited using only a contribution form the adaptive codebook, the pitch gain is set to $g_f$ at block 306, proportional to the LP synthesis filter energies as noted above and detailed further below. An error measure for that particular combination is determined and stored at block 308. The computing process repeats 310 for a few iterations so as not to delay transmission, preferably bounded by a number of subframes or a time constraint. Once all iterations are complete, a minimum error is determined 312 and the individual subframes are excited by the linear prediction filter 314 according to the gains that yielded the minimum error measure, and transmitted 316. Note that what the encoder may perform each of steps 301 through 314 of FIG. 3, where the encoder is read broadly to include calculations done by a processor and excitation done by a filter, even if the processor and filter are disposed separately from the encoding circuitry. The functional blocks of FIG. 2 are not to imply separate components in all embodiments; several such blocks may be incorporated into an encoder.

A decoder according to the invention operates similarly, though it need not iteratively determine how to arrange subframe units in a frame since it receives the frame over a channel already. The decoder determines which subframe unit is encoded without the fixed codebook contribution, preferably from a bit set in the frame at the transmitter. The decoder has a first input coupled to a codebook and a second input for receiving the encoded frame of a speech signal. As with the transmitter, the encoded frame includes at least two subframe units. Like the encoder, the decoder searches the codebook for a fixed codebook contribution and for an adaptive codebook contribution. It decodes at least one of the subframe units without the fixed codebook contribution.

Figure 4:
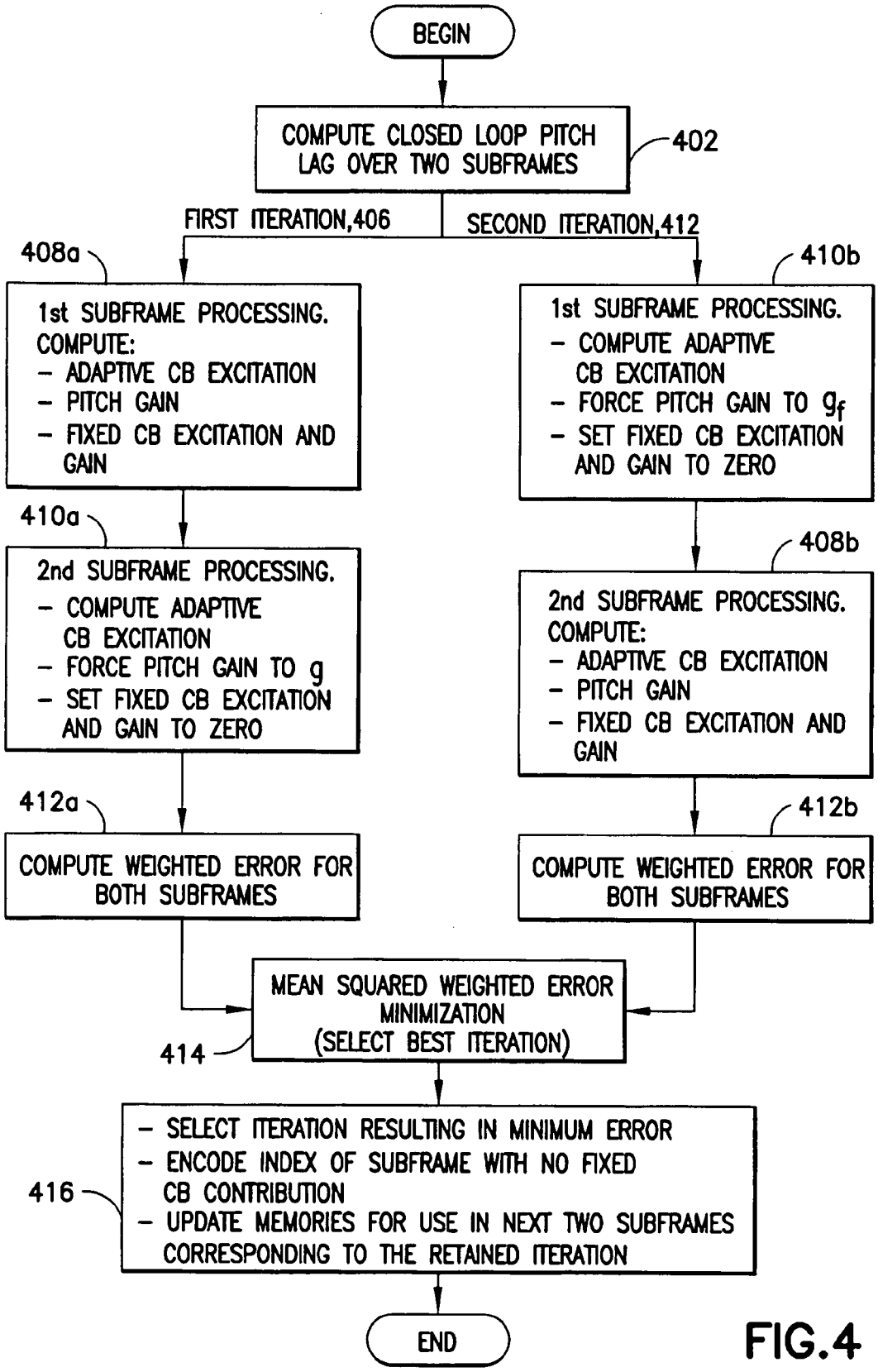
FIG. 4 is process flow diagram according to a second embodiment of the invention.

According to a second embodiment shown generally at FIG. 4, the subframes are grouped in frames of two subframes. The pitch lag is computed over the two subframes 402. Then the excitation is computed every subframe by forcing the pitch gain to a certain value $g_f$ in either first or second subframe. For the subframe where the pitch gain is forced to $g_f$, no fixed codebook is used (the excitation is based only on the adaptive codebook contribution). The subframe in which the pitch gain is forced to $g_f$ is determined in closed loop 402 by trying both combinations and selecting the one that minimizes the weighted error over the two subframes. In the first iteration 406, the pitch gain and adaptive codebook excitation and the fixed codebook excitation and gain are computed in the first subframe 408*a*, and in the second subframe the pitch gain is forced to $g_f$ and the adaptive codebook excitation is computed with no fixed codebook contribution 410*a*. In the second iteration 412, in the first subframe the pitch gain is forced to $g_f$ and the adaptive codebook excitation is computed with no fixed codebook contribution 410*b*, and in the second subframe the pitch gain and adaptive codebook excitation and the fixed codebook excitation and gain are computed 408*b*. The weighted error is computed for both iterations 412*a*, 412*b* and the one that minimizes the error is retained 414 and selected for transmission 416. One bit may be used per two subframes to determine the index of the subframe where fixed codebook contribution is used.

In a third embodiment, the fixed codebook contribution is used in one out of two subframes. In the subframes with no fixed codebook contribution, the pitch gain is forced to a certain value $g_f$. The value is determined as the ratio between the energies of the LP synthesis filters in the previous and present frames, constrained to be less or equal to one. The value of $g_f$ is given by:

$$g_f = \frac{\sum_{n=0}^{127} h_{LPold}^2(n)}{\sum_{n=0}^{127} h_{LPnew}^2(n)} \text{ constrained by } g_f \le 1; \tag{1}$$

where $h_{LPold}(n)$ and $h_{LPnew}(t)$ denote the impulse responses of the previous and present frames, respectively. For stable voiced segments, the value of $g_f$ is close to one. Determining $g_f$ using the ratio above forces the pitch gain to a low value when the present frame becomes resonant. This avoids an unnecessary raise in the energy. The process is similar to that shown in FIG. 4, but the pitch gain is given particularly as above.

The subframe in which the pitch gain is forced to $g_f$ is determined in closed loop by trying both combinations and selecting the one that minimizes the weighted error over the half-frame. Determining the excitation in each two subframes is performed in two iterations. In the first iteration, the excitation is determined in the first subframe as usual. The adaptive codebook excitation and the pitch gain are determined. Then the target signal for fixed codebook search is updated and the fixed codebook excitation and gain are computed, and the adaptive and fixed codebook gains are jointly quantized.

In the second subframe, the adaptive codebook memory is updated using the total excitation from the first subframe, then the pitch gain is forced to $g_f$ and the adaptive codebook excitation is computed with no fixed codebook contribution. Thus, the total excitation from the first iteration in the first subframe is given by:

$$u_{sf1}^{(1)}(n)=\hat{g}_p^{(1)}v_{sf1}^{(1)}(n)+\hat{g}_c^{(1)}c_{sf1}^{(1)}(n),\ n=0,\ldots,63. \tag{2}$$

and the total excitation in the second subframe is given by:

$$u_{sf2}^{(1)}(n)=g_f^{(1)}v_{sf2}^{(1)}(n)\ n=0,\ldots,63. \tag{3}$$

Before starting the second iteration, the memories of the synthesis and weighting filters and the adaptive codebook memories are saved for the two subframes.

In the second iteration, in the first subframe the pitch gain is forced to $g_f$ and the adaptive codebook excitation is computed with no fixed codebook contribution. The total excitation in the first subframe is then given by:

$$u_{sf1}^{(2)}(n)=g_f^{(2)}v_{sf1}^{(2)}(n)\ n=0,\ldots,63. \tag{4}$$

Then, the memory of the adaptive codebook and the filter's memories are updated based on the excitation from the first subframe.

In the second subframe, the target signal is computed, and adaptive codebook excitation and pitch gain are determined. Then the target signal is updated and the fixed codebook excitation and gain are computed. The adaptive and fixed codebook gains are jointly quantized. The total excitation in the second subframe is thus given by:

$$u_{sf2}^{(2)}(n)=\hat{g}_p^{(2)}v_{sf2}^{(2)}(n)+\hat{g}_c^{(2)}c_{sf2}^{(2)}(n),\ n=0,\ldots,63 \tag{5}$$

Finally, to decide which iteration to choose, the weighted error is computed for both iterations over the two subframes, and the total excitation corresponding to the iteration resulting in smaller mean-squared weighted error is retained. 1 bit is used per half-frame to indicate the index of the subframe where fixed codebook contribution is used (or vice versa).

The weighted error for two subframes in the first iteration is given by:

$$\begin{aligned} e_{sf1}^{(1)}(n) &= \hat{g}_p^{(1)} y_{sf1}^{(1)} + \hat{g}_c^{(1)} z_{sf1}^{(1)}(n), & n = 0, \ldots, 63 \\ e_{sf2}^{(1)}(n) &= g_f^{(1)} y_{sf2}^{(1)}(n), & n = 0, \ldots, 63 \end{aligned}; \tag{6}$$

and the weighted error for two subframes in the second iteration is given by:

$$\begin{aligned} e_{sf1}^{(2)}(n) &= g_f^{(2)} y_{sf2}^{(2)}(n), & n = 0, \ldots, 63 \\ e_{sf2}^{(2)}(n) &= \hat{g}_p^{(2)} y_{sf2}^{(2)}(n) + \hat{g}_c^{(2)} z_{sf2}^{(2)}(n), & n = 0, \ldots, 63 \end{aligned}; \tag{7}$$

where y(n) and z(n) are the filtered adaptive codebook and filtered fixed codebook contributions, respectively.

In case the first iteration is retained, the saved memories are copied back into the filter memories and adaptive codebook buffer for use in the next two subframes (since after both iterations are preformed the filter memories and adaptive codebook buffer correspond to the second iteration).

The various embodiments of this invention may be implemented by computer software executable by a data processor of the mobile station 20 or other host device, such as the processor 28, or by hardware, or by a combination of software and hardware. Further in this regard it should be noted that the various blocks of the figures may represent program steps, or interconnected logic circuits, blocks and functions, or a combination of program steps and logic circuits, blocks and functions.

The memory or memories 34 may be of any type suitable to the local technical environment and may be implemented using any suitable data storage technology, such as semiconductor-based memory devices, magnetic memory devices and systems, optical memory devices and systems, fixed memory and removable memory. The data processor(s) 28 may be of any type suitable to the local technical environment, and may include one or more of general purpose computers, special purpose computers, microprocessors, digital signal processors (DSPs) and processors based on a multicore processor architecture, as non-limiting examples.

In general, the various embodiments may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

Although described in the context of particular embodiments, it will be apparent to those skilled in the art that a number of modifications and various changes to these teachings may occur. Thus, while the invention has been particularly shown and described with respect to one or more embodiments thereof, it will be understood by those skilled in the art that certain modifications or changes may be made therein without departing from the scope and spirit of the invention as set forth above, or from the scope of the ensuing claims, most especially when such modifications achieve the same result by a similar set of process steps or a similar or equivalent arrangement of hardware.

What is claimed is:

1. A method for coding a speech signal, the method comprising:

dividing a speech signal into a plurality of frames;

dividing at least one of the plurality of frames into at least two subframe units;

searching in a memory of an apparatus for a fixed codebook contribution and an adaptive codebook contribution for subframe units;

preparing two or more different combinations of subframe units for coding a given frame, wherein in each combination at least one subframe unit is coded without the fixed codebook contribution and at least one subframe unit is coded with the fixed codebook contribution; and selecting one of the combinations and outputting the selected combination for transmission.

2. The method of claim 1, wherein a fixed pitch gain is applied to at least one of the subframe units that is coded without the fixed codebook contribution in the selected combination.

3. The method of claim 2, wherein the fixed pitch gain is calculated on the basis of energies of a current frame that comprises the selected combination and of a previous frame.

4. The method of claim 3, wherein the fixed pitch gain is calculated:

$$g_f = \frac{\sum_{n=0}^{127} h_{LPold}^2(n)}{\sum_{n=0}^{127} h_{LPnew}^2(n)} \text{ constrained by } g_f \leq 1;$$

wherein $h_{LPold}(n)$ and $h_{LPnew}(n)$ denote respective impulse responses of the previous frame and the current frame.

5. The method of claim 1, wherein preparing and selecting comprise:

assembling a first combination of the at least one subframe unit with the fixed codebook contribution and the at least one subframe unit without the fixed codebook contribution, and assembling a second combination of at least one subframe unit without the fixed codebook contribution and at least one subframe unit with the fixed codebook contribution; and selecting only one of the first and second combinations for transmission.

6. The method of claim 5, wherein assembling the first and second combinations comprises assembling subframe units so as to minimize an error measure across a frame which comprises the selected combination.

7. The method of claim 6, wherein assembling subframe units so as to minimize the error measure comprises iteratively assembling different combinations of subframe units and selecting for transmission a particular combination that minimizes the error measure across the frame.

8. The method claim 1, wherein selecting is based on calculating a criteria for different assemblies made of subframe units coded with the fixed codebook contribution and without the fixed codebook contribution.

9. The method of claim 8, wherein the criteria comprises a mean squared weighted error.

10. The method of claim 1, further comprising setting at least one bit in a frame which comprises the selected combination to indicate which at least one subframe was coded with no fixed codebook contribution.

11. The method of claim 1, wherein the subframe units comprise half-frames.

12. The method of claim 1, wherein the subframe units comprise quarter-frames.

13. An encoder comprising:

a first input that interfaces to a codebook; and a second input configured to receive a speech signal;

wherein the encoder is configured, for the received speech signal, to search the codebook for a fixed codebook contribution and for an adaptive codebook contribution and to output the speech signal as a frame comprising at least two subframe units, and the encoder is further configured to encode at least one subframe unit of the frame without the fixed codebook contribution, to prepare two or more different combinations of subframe units for coding a given frame, wherein in each combination at least one subframe unit is coded without the fixed codebook combination and at least one subframe unit is coded with the fixed codebook contribution, and to select one of the combinations for output.

14. The encoder of claim 13, wherein the encoder assembles a first combination of at least one subframe unit with the fixed codebook contribution and at least one subframe unit without the fixed codebook contribution, and assembles a second combination of at least one subframe unit without the fixed codebook contribution and at least one subframe unit with the fixed codebook contribution; and the encoder outputs only one of the first and second combinations.

15. The encoder of claim 14, wherein the encoder assembles the first and second combination so as to minimize an error measure across the combinations.

16. The encoder of claim 15, wherein assembling subframe units so as to minimize the error measure comprises iteratively assembling different combinations of subframe units and selecting for transmission a particular combination that minimizes the error measure across the frame.

17. The encoder of claim 13, wherein the encoder further operates to encode at least one other subframe unit with the fixed codebook contribution to form a first combination, and to encode the at least one subframe unit with the fixed codebook contribution and the at least one another subframe unit without the fixed codebook contribution to form a second combination, the encoder outputting only one of the first and second combinations based on a criteria.

18. The encoder of claim 17, wherein the criteria comprises a mean squared error.

19. A computer readable storage medium embodied with a computer program of machine-readable instructions executable by a digital data processor, to perform actions directed toward encoding a speech frame, the actions comprising:

dividing a speech signal into a plurality of frames;

dividing at least one of the plurality of frames into at least two subframe units;

searching for a fixed codebook contribution and an adaptive codebook contribution for subframe units;

preparing two or more different combinations of subframe units for coding a given frame, wherein in each combination at least one subframe unit is coded without the fixed codebook combination and at least one subframe unit is coded with the fixed codebook contribution; and selecting one of the combinations.

20. The computer readable storage medium of claim 19, wherein the actions further comprise:

assembling a first combination of at least one subframe unit with the fixed codebook contribution and at least one subframe unit without the fixed codebook contribution, and assembling a second combination of at least one subframe unit without the fixed codebook contribution and at least one subframe unit with the fixed codebook contribution; and selecting only one of the first and second combinations for transmission.

21. The computer readable storage medium of claim 20, wherein assembling the first and second combinations comprises assembling subframe units so as to minimize an error measure across the frame.

22. The computer readable storage medium of claim 21, wherein assembling subframe units so as to minimize the error measure comprises iteratively assembling different combinations of subframe units and selecting for transmission a particular combination that minimizes the error measure across the frame.

23. The computer readable storage medium of claim 19, wherein selecting is based on calculating a criteria for different assemblies made of subframe units coded with the fixed codebook contribution and without the fixed codebook contribution.

24. The computer readable storage medium of claim 23, wherein the criteria comprises a mean squared weighted error.

25. An encoding device comprising:

means for dividing a speech signal into a plurality of frames;

means for dividing at least one of the plurality of frames into at least two subframe units;

means for searching for a fixed codebook contribution and an adaptive codebook contribution for subframe units;

means for preparing two or more different combinations of subframe units for coding a given frame, wherein in each combination at least one subframe unit is coded without the fixed codebook combination and at least one subframe unit is coded with the fixed codebook contribution; and means for selecting one of the combinations for transmission.

26. The encoding device of claim 25, wherein the means for dividing a speech signal into a plurality of frames and the means for dividing at least one of the plurality of frames into at least two subframe units comprises an encoder;

the means for searching comprises a processor coupled to the encoder and to a computer readable memory that stores a codebook; and the means for selecting comprises the processor.

27. The encoding device of claim 25, further comprising gain means for applying a fixed pitch gain to at least one of the subframe units that is coded with no fixed codebook contribution in the selected combination.

28. The encoding device of claim 27, further comprising processing means for calculating the fixed pitch gain on the basis of energies of a current frame that comprises the selected combination and a previous frame.

29. The encoding device of claim 28, wherein processing means calculates the fixed pitch gain $g_f$ by:

$$g_f = \frac{\sum_{n=0}^{127} h_{LPold}^2(n)}{\sum_{n=0}^{127} h_{LPnew}^2(n)} \text{ constrained by } g_f \leq 1;$$

wherein $h_{LPold}(n)$ and $h_{LPnew}(n)$ denote respective impulse responses of the previous frame and the current frame.

30. The encoding device of claim 25, wherein the further comprising means for setting at least one bit in a frame which comprises the selected combination to indicate which at least one subframe was coded with no fixed codebook contribution.

31. The encoding device of claim 25, wherein the subframe units comprise half-frames.

32. The encoding device of claim 25, wherein the subframe units comprise quarter-frames.

33. A decoder comprising:

a first input that interfaces to a codebook; and a second input configured to receive an encoded frame of a speech signal, said encoded frame comprising at least two subframe units;

wherein the decoder is configured, for the received encoded frame, to search the codebook for a fixed codebook contribution and for an adaptive codebook contribution and to decode at least one of the subframe units without the fixed codebook contribution where a fixed pitch gain has been applied and to decode another of the at least two subframe units coded with both the fixed codebook contribution and the adaptive codebook contribution, wherein the decoder reads a bit in the frame and determines which subframe unit to decode without the fixed codebook contribution based on the bit.

34. The decoder of claim 33, wherein the subframe units comprise half-frames.

35. The decoder of claim 33, wherein the subframe units comprise quarter-frames.

36. A communication system comprising an encoder and a decoder, where the encoder comprises:

a first input interfacing to a codebook; and a second input configured to receive a speech signal to be transmitted;

wherein the encoder is configured, for the received speech signal, to search the codebook for a fixed codebook contribution and for an adaptive codebook contribution and to output the speech signal as a frame comprising at least two subframe units, and the encoder is further configured to encode at least one subframe unit of the frame without the fixed codebook contribution, to prepare two or more different combinations of subframe units for coding a given frame, wherein in each combination at least one subframe unit is coded without the fixed codebook combination and at least one subframe unit is coded with the fixed codebook contribution, and to select one of the combinations for this transmission; and where the decoder comprises:

a first input interfacing to a codebook; and a second input configured to receive an encoded frame of a speech signal over a channel, said encoded frame comprising at least two subframe units;

wherein the decoder is configured, for the received encoded frame, to search the codebook for a fixed codebook contribution and for an adaptive codebook contribution and to decode at least one of the subframe units of the encoded frame without the fixed codebook contribution where a fixed pitch gain has been applied and to decode another of the at least two subframe units coded with both the fixed codebook contribution and the adaptive codebook contribution, wherein the decoder reads a bit in the frame and determines which subframe unit to decode without the fixed codebook contribution based on the bit.

37. The communication system of claim 36, wherein the fixed pitch gain is calculated on the basis of energies of a current frame and a previous frame.

38. The communication system of claim 36, wherein the encoder operates to assemble a first combination of at least one subframe unit with the fixed codebook contribution and at least one subframe unit without the fixed codebook contribution, and to assemble a second combination of at least one subframe unit without the fixed codebook contribution and at least one subframe unit with the fixed codebook contribution; and to output only one of the first and second combinations.

39. The communication system of claim 38, wherein the encoder operates to set a bit in the frame indicative of which subframe unit is encoded without the fixed codebook contribution.

40. The communication system of claim 38, wherein the encoder outputs the first or second combinations as a frame based on an error measure across the first and second combinations.

41. The communication system of claim 40, wherein the error measure comprises a mean squared error measure.

42. The communication system of claim 36, wherein the subframe units comprise half-frames.

43. The communication system of claim 36, wherein the subframe units comprise quarter-frame units.

44. A method for coding a speech signal, the method comprising:

dividing a speech signal into a plurality of frames;

dividing at least one of the plurality of frames into at least two subframe units;

searching for a fixed codebook contribution and an adaptive codebook contribution for subframe units;

selecting at least one subframe unit for a coding, the coding limited to the adaptive codebook contribution;

preparing two or more different combinations of subframe units for coding a given frame, wherein in each combination at least one subframe unit is coded limited to the adaptive codebook contribution and at least one subframe unit is coded with the fixed codebook contribution; and selecting one of the combinations.

45. An encoder comprising:

a first input interfacing to a codebook; and a second input configured to receive a speech signal; and wherein the encoder is configured, for the received speech signal, to search the codebook for a fixed codebook contribution and for an adaptive codebook contribution and to output the speech signal as a frame comprising at least two subframe units, and the encoder is further configured with a contribution limited to the adaptive codebook contribution to encode at least one subframe unit of the frame; to prepare two or more different combinations of subframe units for coding a given frame, wherein in each combination at least one subframe unit is coded limited to the adaptive codebook contribution and at least one subframe unit is coded with the fixed codebook contribution; and to select one of the combinations.

46. A computer readable storage medium embodied with a computer program of machine-readable instructions executable by a digital data processor to perform actions directed toward encoding a speech frame, the actions comprising:

dividing a speech signal into a plurality of frames;

dividing at least one of the plurality of frames into at least two subframe units;

searching for a fixed codebook contribution and an adaptive codebook contribution for subframe units;

preparing two or more different combinations of subframe units for coding a given frame, wherein in each combination at least one subframe unit is coded limited to the adaptive codebook contribution and at least one subframe unit is coded with the fixed codebook contribution; and selecting one of the combinations for transmission.

47. An encoding device comprising:

means for dividing a speech signal into a plurality of frames;

means for dividing at least one of the plurality of frames into at least two subframe units;

means for searching for a fixed codebook contribution and an adaptive codebook contribution for subframe units;

means for preparing two or more different combinations of subframe units for coding a given frame, wherein in each combination at least one subframe unit is coded limited to the adaptive codebook contribution and at least one subframe unit is coded with the fixed codebook contribution; and means for selecting one of the combinations for transmission.

48. A decoder comprising:

a first input interfacing to a codebook; and a second input configured to receive an encoded frame of a speech signal, said encoded frame comprising at least two subframe units; and wherein the decoder is configured, for the received encoded frame, to search the codebook for a fixed codebook contribution and for an adaptive codebook contribution and to decode at least one of the subframe units with a contribution limited to the adaptive codebook contribution where a fixed pitch gain has been applied and to decode another of the at least two subframe units coded with both the fixed codebook contribution and the adaptive codebook contribution, wherein the decoder reads a bit in the frame and determines which subframe unit to decode without the fixed codebook contribution based on the bit.

49. The method of claim 1, further comprising encoding an index of the at least one subframe unit is coded without the fixed codebook contribution.

50. The method of claim 1, further comprising updating the memory with the selected one of the combinations.

* * * * *